United States Patent [19]

Kato

[11] Patent Number: 4,995,776

[45] Date of Patent: Feb. 26, 1991

[54] OPERATING APPARATUS FOR FEEDING, TAKING UP AND TENSIONING A BINDING STRAP

[75] Inventor: Kanami Kato, Sakai, Japan

[73] Assignee: Signode Corporation, Glenview, Ill.

[21] Appl. No.: 335,934

[22] Filed: Apr. 10, 1989

[30] Foreign Application Priority Data

Apr. 15, 1988 [JP] Japan ..... 63-94338

[51] Int. Cl.[5] ..... B65B 13/02

[52] U.S. Cl. ..... 410/100; 53/589; 100/32

[58] Field of Search ..... 410/100; 24/115 L, 115 R; 53/589, 590; 269/130, 131; 100/29, 32, 33 PB, 26

[56] References Cited

U.S. PATENT DOCUMENTS

| | | | |
|---|---|---|---|
| 4,177,721 | 12/1979 | Johnson et al. | 100/26 |
| 4,305,774 | 12/1981 | Wedeking et al. | 100/33 PB |
| 4,383,881 | 5/1983 | Sakaki | 100/33 PB |
| 4,625,500 | 12/1986 | Huber | 53/590 |

FOREIGN PATENT DOCUMENTS

| | | | |
|---|---|---|---|
| 0753716 | 8/1980 | U.S.S.R. | 100/32 |

*Primary Examiner*—Andres Kashnikow
*Assistant Examiner*—Mark T. Le
*Attorney, Agent, or Firm*—Schwartz & Weinrieb

[57] ABSTRACT

A strap binding machine for binding articles includes a traction operating wheel and a back-up operating wheel rotatable in opposite directions so as to achieve forward advancement and rearward retraction of the binding strap whereby feeding, retraction, and high-torque tightening of the binding strap is accomplished with respect to an article to be bound. The back-up wheel is mounted upon an eccentric shaft which is, in turn, mounted upon a connecting link by means of a lever, attached to the eccentric shaft, and a pin engaged within an arcuate slot defined within the lever. The connecting link is attached at one end thereof to a supporting plate upon which is mounted the traction wheel wherein the supporting plate is spring-biased so as to be pivotable in a counterclockwise direction, and the other end of the connecting link is attached to a pneumatic piston-cylinder mechanism. An opening handle is also operatively attached to the eccentric shaft mounting the back-up wheel whereby the gap, bight, or nip defined between the traction and backup wheels is able to be readily enlarged or opened, for insertion of the leading end portion of the binding strap in order to initiate a binding operation, as permitted by means of the lever and connecting link members having the arcuate slot and connecting pin defined and provided therein, respectively.

10 Claims, 3 Drawing Sheets

FIG. 2
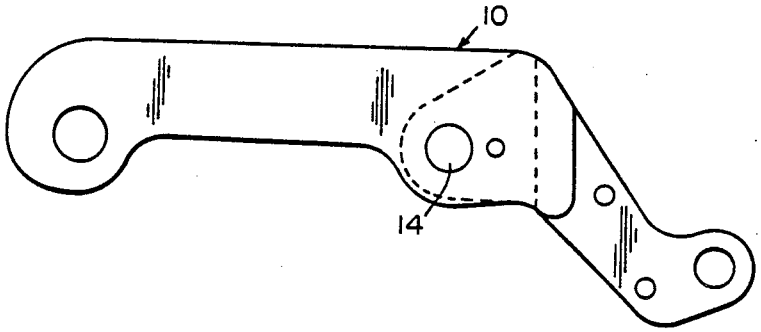
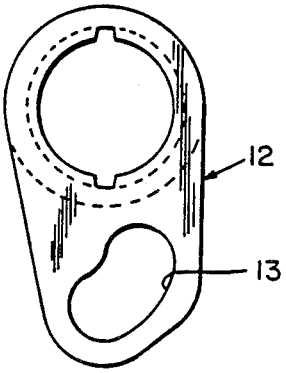
FIG. 3
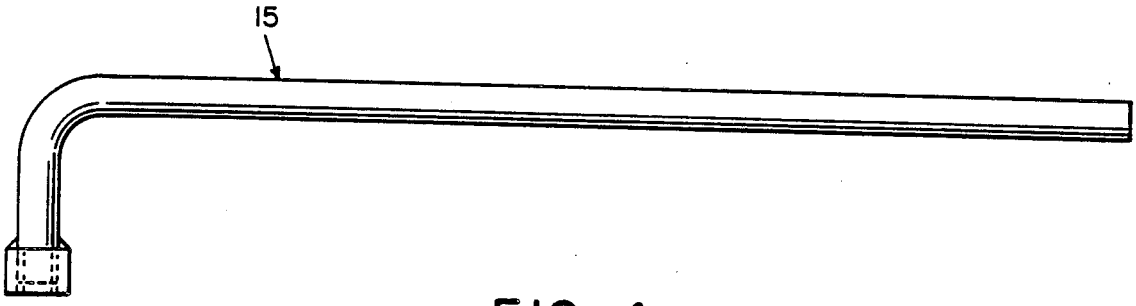
FIG. 4

OPERATING APPARATUS FOR FEEDING, TAKING UP AND TENSIONING A BINDING STRAP

FIELD OF THE INVENTION

The present invention relates generally to a binding machine for securely binding heavy articles with a steel-band strap, and more particularly, to a binding apparatus for feeding, taking-up, and strongly tensioning or tightening the binding strap which is normally retained between a pair of operating wheels cooperatively disposed within the binding head of the binding machine, wherein the binding apparatus incorporates a mechanism which is capable of facilitating the sledding or introduction of the forward or leading end of the binding strap into the gap defined between the pair of cooperating wheels by enlarging the gap or opening defined between the wheels during the initiation of the binding operation.

BACKGROUND OF THE INVENTION

In order to bind heavy articles, such as, for example, strip coils, tubes, stacked plates, and the like, it is normally required that such articles be wound or bound with or by means of a binding strap exhibiting a high degree of tension, such as, for example, a steel band, the degree of tension being in fact of such a degree as to have a value which is close to the tensile strength of the steel band at which the steel band will tend to break. Upon achieving the predetermined degree of tension, the strap end portions are then bonded to each other so as to complete the binding operation.

With reference initially being made to FIG. 5, there is schematically shown one example of a conventional binding machine of the aforenoted type within which the strap-binding operation may be carried out by means of a multi-functional binding head 1 which is vertically movable with respect to the binding machine frame, and in connection with which the apparatus of the present invention may be employed.

More particularly, a band-like binding strap 3 is interposed between a pair of operating wheels 2 of the binding head 1 so as to be held therebetween and fed in a direction shown by means of an arrow f as a result of the rotation of both wheels 2 in a first forward direction. The strap is wound around articles 4 to be bound, through means of one revolution thereabout, and the leading or forward end portion **3*a* of the strap 3 is gripped by means of a gripping unit, not shown, disposed within the binding head 1. The trailing or rear end portion 3*b* of the binding strap 3 is taken up or retracted in the opposite direction shown by means of the arrow tt as a result of the rotation of the wheels 2 in a second reverse direction, thereby causing the strap 3 to bind the article 4 without any looseness or slack. In particular, the trailing end portion 3*b* of the strap 3 is grasped and moved in the reverse direction tt so as to strongly tension the entire strap 3 disposed around the article 4, whereupon the overlapping portions of the binding strap 3, comprising the leading or forward end portion 3*a* and the trailing or rear end portion 3*b*, are bonded together, while under such tensioned conditions, by means of a suitable bonding or fusing mechanism, not shown, disposed within the binding head 1**.

After the overlapping strap portions **3*a* and 3*b* have been bonded to each other, the strap portion 3*c* disposed upstream of the bonded junction defined between straps portions 3*a* and 3*b* is cut and separated from the article-encircling binding strap 3. It is additionally noted that when the head portion which has served as an underlying foundation for the bonded strap portions is transversely removed, the bonded strap portion is loosened to a predetermined extent corresponding to the thickness of the removed head portion, or in other words, by the amount defined by means of the gap residually defined by means of the removed head portion. However, such looseness is in fact absorbed within a predetermined range characterized by the inherent resiliency within the binding strap, and the tension developed therein, such that the residual tension still present within the binding strap is sufficient to retain a strong binding state with respect to the article 4** being bound.

Continuing further, in accordance with the conventional apparatus as shown in FIG. 6, one of the operating wheels 2 comprises a traction wheel 2T which is provided with a grooved peripheral surface, while the other operating wheel comprises a back-up wheel 2B having a smooth peripheral surface. The backup wheel 2B is rotatably supported so as to rotate about an axis b with respect to the frame of the binding head 1, while the traction wheel 2T is rotatably supported so as to be rotatable about an axis t which is displaced with respect to a pivotal axis X of an eccentric housing 5 by means of an eccentric amount x. The system is so constructed that when the eccentric housing 5 is pivoted about its axis X by means of a spring 6 interposed between the eccentric housing 5 and the frame of the binding head 1, the traction wheel 2T undergoes eccentric movement so as to come into contact with the back-up wheel 2B.

Consequently, it is to be appreciated that the strap 3 can be fed in the first forward direction f, and taken up or retracted in the second reverse direction tt as a result of a relatively small biasing force developed by means of the spring 6, and as a result of a relatively small amount of torque as developed by means of the drive system. Continuing further, when a large amount of resistance is encountered, such as, for example, during the final stage of taking up or retracting the strap 3, that is, during the tightening or tensioning of the strap 3 in order to achieve the encircled binding of the article 4, the drive system is switched so as to be operable within a low-speed, high-torque mode. Such an operation applies a large degree of tension to the binding strap, and such tension causes both wheels to be disposed in contact with each other with a small wedge angle $\alpha$ defined therebetween and wherein the wheels tend to move in the direction f so as to, in turn, tend to reduce the wedge angle $\alpha$, as is seen in FIG. 6. Accordingly, the contact force developed between the wheels is increased by means of such wedging effect whereby a high degree of tensioning of the binding strap in the direction tt is effectively achieved in a self-energizing manner in view of the fact that the strap tension will increase as a function of the increasing contact force developed or generated between the operating wheels 2T and 2B.

The steel-band strap 3 employed within the aforenoted type of apparatus conventionally has a width of 0.75–1.25 inches (19–32 mm), a thickness of approximately 0.9 mm, and a tensile strength of approximately 75–100 kgs/mm$^2$. Consequently, the strap is especially well-suited for high-tension forces applied thereto during the strap-tensioning operation, and in fact can withstand pressure contact forces which are several magnitudes greater than that of its tensile strength. It is lastly noted that the gap defined between the operating wheels 2T and 2B is designated as g.

According to the conventional apparatus, when both wheels are brought to their respective positions wherein the strap is held therebetween and the aforenoted self-energizing tensioning process effectively proceeds accordingly, the final-stage wedge angle $\alpha$ is within the range of approximately 5°-6°, and the gap g defined between the wheels 2T and 2B is smaller as compared with respect to the strap thickness. It is of course appreciated that the gap g will undergo small variations with respect to, or as a function of, the variations of the angle $\alpha$ when the latter has a value which is within the vicinity of the aforenoted small-angle range. Accordingly, during the time that sledding takes place wherein the leading end or tip of the strap is introduced between both wheels 2T and 2B by increasing the size of the gap g, it is required that the gap g be increased to a size approximately equal to 2.5 mm which includes a surplus amount of space or width of the gap so as to compensate for, or accommodate, any variations in the strap thickness or irregularities attendant the configuration or shape of the cut leading end or tip portion of the strap. In this connection, the moving and operating angle of a handle 7, which is attached to the eccentric housing 5, should be substantial. This requirement, however, increases the displacement movement of the eccentric housing 5 and its relevant drive system. Such, in turn, requires the overall apparatus to be significantly large in size. Furthermore, since the lever operation must also be carried out against the load of the spring 6, the resistance encountered is significantly increased.

OBJECT OF THE INVENTION

Accordingly, it is an object of the present invention to overcome such aforenoted problems characteristic of the prior art, such as, for example, the necessity of having a large-sized apparatus, a heavier binding head, and the difficulty in achieving the sledding operation.

SUMMARY OF THE INVENTION

In order to achieve the aforenoted object, the apparatus constructed in accordance with the present invention is arranged such that interposed between one operating wheel rotatably supported upon a first axis at a predetermined position, and another operating wheel rotatably supported upon a second axis of an eccentric shaft and which is adapted to approach the first operating wheel as a result of the rotation of the eccentric shaft, there is provided a mechanism for transmitting the pivotal movement to the eccentric shaft supporting the other operating wheel which comprises a piston-cylinder member for initiating the pivotal movement, a connecting link connected at one end thereof to the piston-cylinder member and to a pivotable support plate, upon which the first operating wheel is rotatably supported, at the other end thereof, and a lever which is attached at one end thereof to the eccentric shaft and at the other end thereof to the connecting link through means of a pin mounted upon the connecting link and an elongated, obliquely inclined slot formed within the lever.

The strap binding apparatus is of the type in which a binding strap is fed as a result of being disposed within a nip or bight of a pair of reversibly driven operating wheels, as noted above, disposed within a binding head, whereby the strap is wound about articles to be bound as a result of one revolution thereabout. In accordance with the conventional winding and binding process, after the strap has been wound about the article to be bound, the leading end of the strap is gripped, the trailing end portion of the strap is retracted so as to bind the article without any looseness or slack within the binding strap, and the trailing end portion of the strap is retracted still further so as to tighten the binding strap under high tension conditions. Subsequently, the overlapping leading and trailing end portions of the binding strap bonded together under such high tension conditions so as to secure the binding strap about the article to be bound.

In accordance with the present invention, a spring is also interposed between the binding head framework, upon which the piston-cylinder member is mounted, and the pivotable support plate upon which the first operating wheel is rotatably supported, such that the spring biasing force or load impressed upon the pivotable support plate is transmitted to the other operating wheel mounted upon the eccentric shaft through means of the connecting link, the connecting pin, and the lever having the oblique arcuately-shaped slot defined therein and within which is disposed the connecting pin. In this manner, the first and second operating wheels are forced together or towards each other with a predetermined force so as to securely retain and feed the binding strap disposed within the bight or nip defined between the operating wheels.

In accordance with a particular feature of the present invention, in order to initially introduce the leading end of the binding strap into the bight or nip defined between the two operating wheels, the second operating wheel is caused to pivot away from the first operating wheel as a result of counterclockwise pivotal movement of an operating handle attached to the eccentric shaft upon which the second operating wheel is mounted. Accordingly, the gap defined between the two operating wheels is increased so as to in fact permit or facilitate the introduction of the leading end of the binding strap into the gap, bight, or nip defined between the two operating wheels. In addition, it is especially noted that the aforenoted opening or widening of the gap, bight, or nip defined between the two operating wheels is in fact able to increased without encountering any additional resistance against the biasing force of the spring in view of the fact that the pivotal movement of the eccentric shaft and the second operating wheel is, in effect, dissociated from the spring biasing mechanism. Still further, the provision of the particular linkage system of the present invention, and especially the fact that such is operatively associated with the operating wheel which is not mounted in a spring-biased manner, as is the case of the conventional prior art systems, permits the overall size of the binding head to be substantially reduced.

BRIEF DESCRIPTION OF THE DRAWINGS

Various other objects, features, and attendant advantages of the present invention will be better understood from the following detailed description, when considered in connection with the accompanying drawings in which like reference characters designate like or corresponding parts throughout the several views, and wherein:

FIG. 2 is a side view of a connecting link used within the apparatus system of FIG. 1;

FIG. 3 is a side view of a lever used within the apparatus system of FIG. 1;

FIG. 4 is a side view of an opening handle to be used in conjunction with the eccentric shaft of FIG. 1;

DETAILED DESCRIPTION OF THE PREFERRED EMBODIMENT

Figure 1:
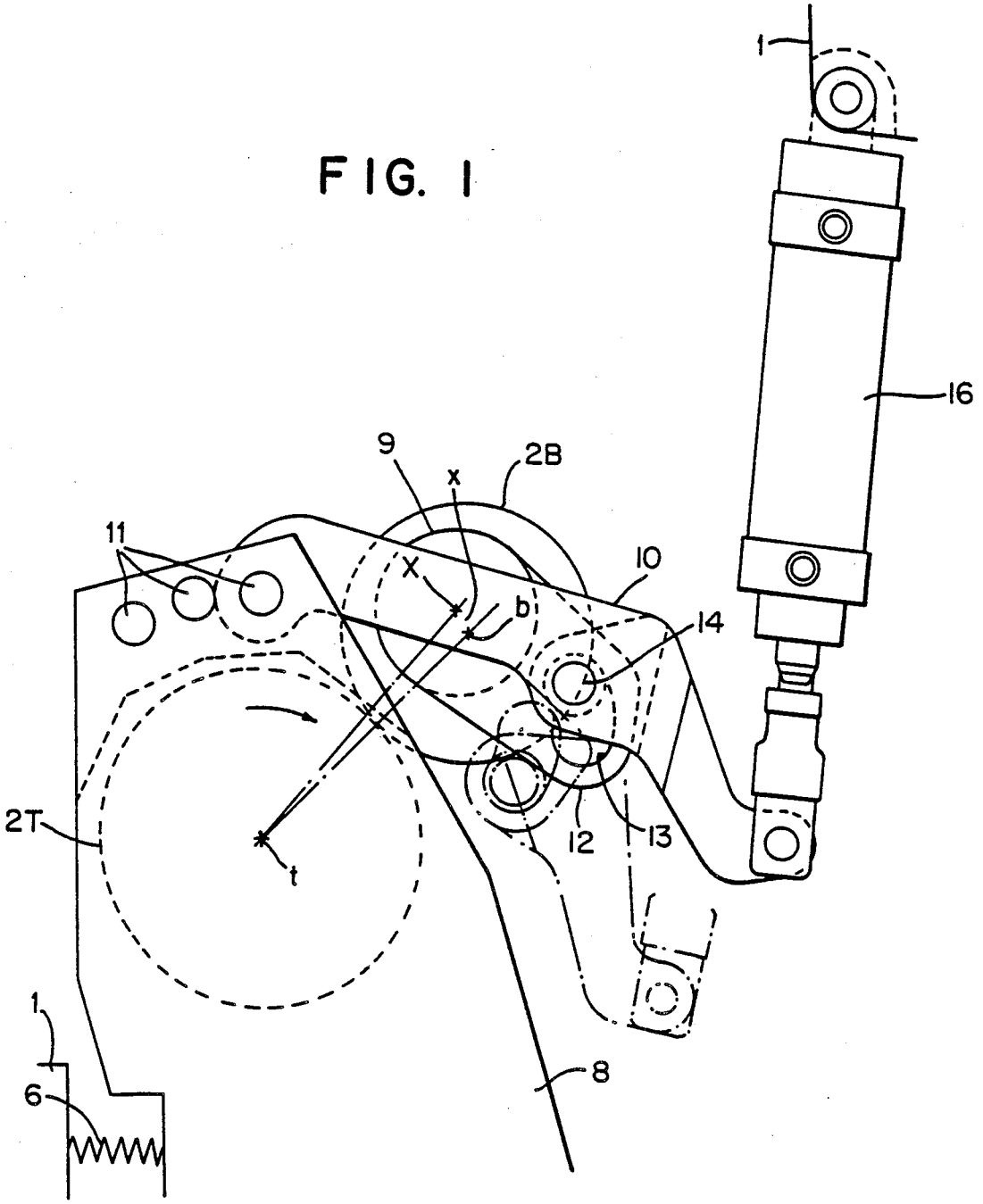
FIG. 1 is a side elevation view of the main components of an apparatus constructed in accordance with the present invention for feeding, retracting, and tensioning-binding a binding strap about an article to be bound, and the showing the operative interrelationship of such components.

Referring now to the drawings, and more particularly to FIGS. 1–4 thereof, there will now be provided a detailed description of a preferred embodiment of a strap binding apparatus system constructed in accordance with the principles of the present invention, and showing the various operative components thereof. More particularly, FIG. 1 shows, in side elevation, the various major or primary components of a strap binding apparatus which feeds, retracts, and tensions or tightens a binding strap within a binding head 1. Head 1 is disposed within an overall strap binding system for binding an article to be bound as is illustrated in FIG. 5, wherein a binding strap 3 is held by and between a pair of operating wheels 2 disposed within the binding head 1, the wheels 2 being more particularly illustrated as wheels 2T and 2B in FIGS. 1 and 6.

Figure 5:
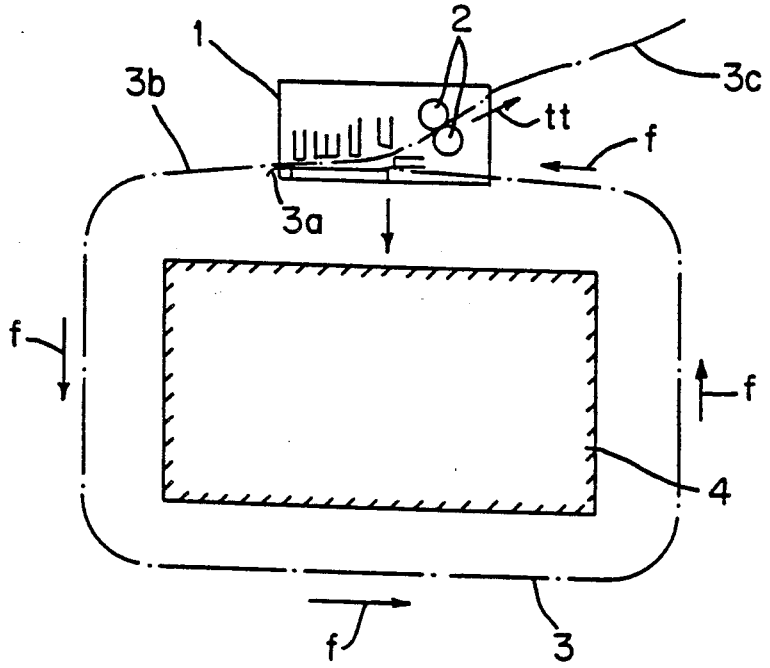
FIG. 5 PRIOR ART
FIG. 5 is a side view schematically illustrating how a strap binding process is conventionally performed.
Figure 6:
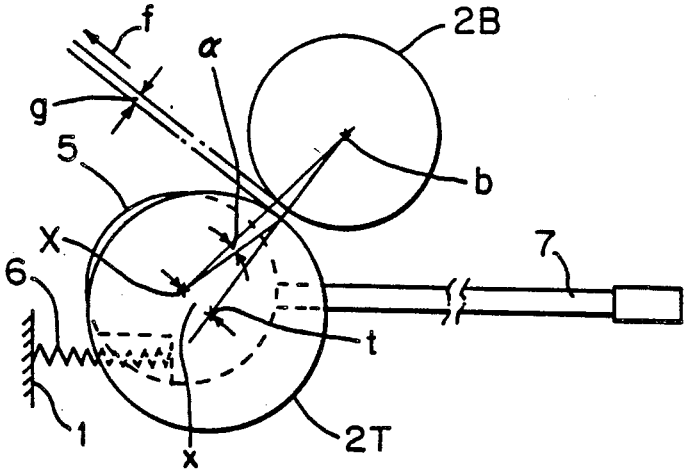
FIG. 6 PRIOR ART
FIG. 6 is a schematic side view partially illustrating a conventional binding strap apparatus system, particularly the two operating wheels for feeding, retracting, and tensioning the binding strap to be used for binding an article to be bound.

In accordance with the strap binding process implemented by means of the apparatus disclosed generally within FIG. 5, the strap 3 is initially fed in a direction f as a result of rotating the wheels 2 in the forward direction whereby the article to be bound is encircled thereabout by means of the binding strap comprising one revolution or coil. The leading end portion 3*a* of the binding strap 3 is then gripped by means of the gripping unit of the binding head, and the trailing end portion 3*b* of the winding strap 3 is then retracted in the opposite direction tt by rotating both operating wheels 2 in the reverse direction. In this manner, the encircling binding strap is tightly wound about the article without any looseness or slack. Subsequently, the binding strap 3 is retracted further so as to apply a predetermined amount of tension to the strap 3 and the article being bound. The overlapping leading and trailing end portions of the binding strap are then bonded together under such high tension conditions, and the upstream portion 3*c* of the binding strap is then severed from bonded portions 3*a*–3*b* whereby binding of the article 4 is completed.

Having described the overall strap binding apparatus system and the binding process implemented thereby, attention will now be directed to the embodiment of the present invention illustrated within FIGS. 1–4 which disclose an improvement of the mounting system for the operating wheels 2, and more particularly wheels 2T and 2B. In particular, a first one of the two operating wheels, that is, a traction wheel 2T, having a grooved peripheral surface, is operatively connected to a drive system, not shown, such that the traction wheel 2T is driven about an axis t at a predetermined position or distance with respect to the binding head frame 1. A supporting plate 8 is provided for supporting the drive system for the traction wheel 2T, and plate 8 is likewise pivotable about axis t. It is further appreciated that supporting plate is biased in the counterclockwise direction, as viewed in FIG. 1, by means of a spring 6 interposed between the supporting plate 8 and the binding head frame 1.

The second one of the two operating wheels, that is, a back-up wheel 2B, having a smooth peripheral surface, is eccentrically mounted upon an eccentric shaft 9 which is rotatably mounted upon the binding head frame 1 about a base axis X, the back-up wheel 2B being rotatable about an axis b which is displaced by means of an eccentric amount x with respect to the base axis X of the eccentric shaft 9. The eccentric amount x is predeterminedly set to be, for example, 5 mm, and the gap defined between the two operating wheels, when the same are disposed at their closest positions with respect to each other, is predeterminedly set to be approximately 0.2 mm; in this manner, there is no interference generated between the wheels so as not to prevent the rotation thereof as necessary.

In order to transmit rotary motion between the supporting plate 8 and the eccentric shaft 9, a connecting link 10, as more particularly shown in FIG. 2, is connected, at one end thereof, to supporting plate 8 by means of a pin, not shown, which may be selectively engaged within one of a plurality of pin holes 11 defined within supporting plate 8. Attached to the eccentric shaft 9 is a lever 12, as more particularly shown in FIG. 3, which has an elongated, substantially arcuately extending or obliquely bent slot 13 defined therein for engagement with a connecting pin 14 which is mounted upon an intermediate portion of connecting link 10. Eccentric shaft 9 also has an opening handle 15, as more particularly shown in FIG. 4, attached thereto, and a pneumatic piston-cylinder assembly 16 has one end thereof attached to a second end portion of connecting link 10 while an opposite end of piston-cylinder assembly is attached to the binding head frame 1.

In accordance with the operation of the apparatus of the present invention, when the supporting plate 8 is biased by means of the spring 6 so as to be rotated in the counterclockwise direction about the axis t while the remaining components of the system are disposed in the state illustrated by means of the solid lines in FIG. 1, that is, the piston-cylinder assembly 16 has been contracted so as to elevate the right end of connecting link 10 such that the connecting pin 14 is disposed at the upper end of slot 13, lever 12 is therefore pulled toward the left as viewed in FIG. 1, by means of connecting link 10 attached to supporting plate 8, such that eccentric shaft 9 is rotated in the clockwise direction. Accordingly, the back-up wheel 2B approaches the traction wheel 2T such that a strap 3, having a thickness of approximately 0.9 mm, is securely retained by and between both operating wheels 2T and 2B, the gap, bight, or nip defined between the wheels 2T and 2B being established by means of a relatively small pressing force established by means of the spring 6 as noted hereinabove. At this stage, it is also noted that the wedge angle $\alpha$ is relatively small and on the order of 5°–6°.

As has been noted hereinabove, the drive system provides the requisite amount of torque to rotate the traction wheel 2T which, in cooperation with the back-up wheel 2B, serves to feed, retract, and tighten the binding strap 3. In particular, after the binding strap has been preliminarily retracted so as to take-up the same such that the encircling strap disposed about the article 4 is free of looseness or any slack, the strap is tightened further under high tension conditions by means of high torque applied thereto as well as the aforenoted self-energization due to the inherent resiliency of the strap per se.

In order to initiate the strap binding process, it is required that the gap g defined between the traction wheel 2T and the back-up wheel 2B into which the leading end 3*a* of the strap 3 is to be introduced, be enlarged. In order to in fact open or enlarge the gap g, the opening handle 15 is rotated so as to in turn rotate the eccentric shaft 9 in the counterclockwise direction so that the back-up wheel 2B is eccentrically moved and separated from the traction wheel 2T. As a result of such pivotal movement, the connecting pin 14 disposed within the slot 13 is moved from the upper end portion of the slot 13 to the lower end portion of the slot 13 as a result of the relative pivotal travel of lever 12 relative to pin 14. The eccentric shaft 9 is thus able to be rotated through means of an angular displacement of at least approximately 10°. Thus, the back-up wheel 2B is eccentrically moved and separated from the traction wheel 2T so as to open or enlarge the gap g to a size of more than 2.5 mm.

Subsequently, the connecting pin 14 can be pushed downwardly by means of the pneumatic piston-cylinder 16, and it is noted that little relative resistance to movement with respect to lever 12 is developed. Furthermore, it is also noted that in view of the fact that the spring loading of the spring 6 acts at a substantially right angle with respect to the direction of rotation of the lever 12, lever 12 is relatively unobstructed in its rotational movements. Accordingly, the opening handle 15 may be readily operated. Still further, it is noted that the shape or configuration of the slot 13 defines the locus along which the connecting pin 14 is moved during such pivotal operations. It is also noted that when the leading end portion of the binding strap 3 is introduced into the gap g of 2.5 mm as defined between the two operating wheels 2T and 2B, and the opening handle 15 is then released, the handle 15 is automatically returned by means of the biasing loading of spring 6 acting through connecting link 10, supporting plate 8, lever 12, and pin 14 disposed within slot 13, to the original state whereby the binding operation may proceed.

It may thus be seen that the present invention exhibits important improvements over the known prior art. In particular, according to the apparatus constructed in accordance with the present invention, when it is sought to bind heavy articles, the initial sledding or introduction of the leading end portion of the firm steel band strap may be achieved by readily operating a handle so as to sufficiently open or enlarge the gap g defined between the two operating wheels 2T and 2B with no adverse effects developed with respect to the strap feeding, retraction, and final tensioning of the same. Furthermore, in order to further improve the compactness of the system, the handle projecting outside of the apparatus may be made in a compact manner so as to in fact enable the apparatus to be relatively compact in size. Along these lines still further, if the traction wheel is disposed or mounted upon the fixed axis, such a structural interrelationship eliminates the need for a relatively large-sized drive system within the binding head. This, in turn, enables the structure of the binding head to be made in a compact design.

Obviously, many modifications and variations of the present invention are possible in light of the above teachings. For example, in the illustrated embodiment, the apparatus is disclosed wherein the traction wheel 2T is disposed upon the fixed axis while the back-up wheel 2B is eccentrically movable, however, the present invention would be equally viable if the movement of the wheels was reversed. Still further, in lieu of the pneumatic piston-cylinder, a suitable spring mechanism may be employed. It is therefore to be understood that within the scope of the appended claims, the present invention may be practiced otherwise than as specifically described herein.

What is claimed is:

1. Apparatus for feeding, taking up, and tensioning a binding strap, comprising:
   - a traction wheel;
   - a back-up wheel operatively associated with said traction wheel for defining a gap therebetween within which a portion of said binding strap can be disposed for movement in forward feeding and reversed retraction directions so as to achieve feeding and tensioning binding operations;
   - a pivotable support plate upon which one of said traction and back-up wheels is mounted;
   - means for eccentrically mounting the other one of said traction and back-up wheels such that said two wheels can relatively approach and separate from each other so as to retain said binding strap within said gap or permit introduction of said binding strap into said gap, respectively;
   - connecting link means for connecting said eccentrically mounted wheel to said support plate; and
   - spring means for biasing said support plate in a direction which will cause said eccentrically mounted wheel to be moved toward said one of said wheels in response to the biasing force of said spring means being transmitted to said eccentrically mounting means through said support plate and said connecting link means.

2. Apparatus as set forth in claim 1, wherein:
   - said traction wheel is mounted upon said support plate.

3. Apparatus as set forth in claim 1, wherein:
   - said back-up wheel is mounted upon said eccentrically mounting means.

4. Apparatus as set forth in claim 1, wherein said connecting link means comprises:
   - a connecting link; and
   - a connecting pin for disposition within a slot defined within said eccentrically mounting means.

5. Apparatus as set forth in claim 4, wherein said eccentrically mounting means comprises:
   - an eccentrical shaft upon which said back-up wheel is eccentrically mounted; and
   - a lever mounted upon said eccentric shaft and provided with said slot within which said connecting pin, mounted upon said connecting link, is disposed.

6. Apparatus as set forth in claim 4, wherein:
   - said slot has a substantially arcuate configuration.

7. Apparatus as set forth in claim 5, further comprising:
   - handle means attached to said eccentric shaft for pivotably rotating said eccentric shaft, said back-up wheel, and said lever, relative to said connecting link, and as permitted by relative movement defined between said connecting pin of said connecting link and said slot of said lever, so as to move said back-up wheel away from said traction wheel in order to enlarge said gap defined between said traction and back-up wheels.

8. Apparatus as set forth in claim 1, further comprising:

means defined upon said support plate for connecting said connecting link means to said support plate at multiple locations whereby selective adjustable connections are defined between said connecting link and said support plate.

9. Apparatus as set forth in claim 1, wherein:

said gap comprises a spacing of 0.2 mm when said two wheels are disposed closest to each other.

10. Apparatus as set forth in claim 7, wherein:

said gap comprises a spacing of 2.5 mm when said wheels are disposed in their relatively open position so as to permit introduction of said binding strap therebetween.

* * * * *